United States Patent [19]

Joncas

[11] 4,195,648

[45] Apr. 1, 1980

[54] ASHTRAY

[76] Inventor: Armand Joncas,
Saint-François-de-Salle, Cte
Roberval, Canada, G0W 1M0

[21] Appl. No.: 839,732

[22] Filed: Oct. 5, 1977

[51] Int. Cl.[2] ..... A24F 13/18; A24F 19/14

[52] U.S. Cl. ..... 131/237; 131/242; 131/235 R

[58] Field of Search ..... 131/240, 231, 235 R, 131/237, 240 E, 242

[56] References Cited

U.S. PATENT DOCUMENTS

| | | | |
|---|---|---|---|
| 1,428,686 | 9/1922 | Fargo | 131/242 X |
| 2,426,528 | 8/1947 | Seme | 131/242 |
| 3,695,277 | 10/1972 | Moffa | 131/237 X |

FOREIGN PATENT DOCUMENTS

| | | | |
|---|---|---|---|
| 1010443 | 6/1952 | France | 131/235 R |
| 616879 | 1/1949 | United Kingdom | 131/235 R |

*Primary Examiner*—Stephen C. Pellegrino

[57] ABSTRACT

An ashtray having a hollow body with a top opening serving as a recipient for extinguished butts, matches and ashes. A unit pivots in this top opening. The unit includes two series of semi-tubular grooves in parallel spaced apart relationship, one series being underneath the other series. The said unit can pivot a half-turn in one direction and a half-turn in the other direction such that the cigarette butts placed in the semi-tubular grooves which are right side up are automatically discharged into the hollow body when the unit is pivoted a half-turn. The hollow body is additionally provided with lateral openings in the form of slits wide enough to admit matches and ashes but not wide enough to admit a cigarette so that the user is obliged to put his cigarettes or butts in the semi-tubular grooves. The semi-tubular grooves have a semi-cylindrical bottom conforming closely to the contours of a cigarette and straight sides rising up in full diameter and in parallel spaced apart relationship from the said bottom at least as high as a cigarette placed in the semi-tubular groove. The semi-tubular grooves thus ensure that a cigarette placed within will be extinguished quickly and automatically.

2 Claims, 3 Drawing Figures

ASHTRAY

The present invention relates to ashtrays and more particularly, to an ashtray which can extinguish cigarettes and cigarillos which have been lit.

Ordinary ashtrays which serve as recipients for ashes as well as supports for lit cigarettes are well known. Such ashtrays must be emptied often since the accumulation of much ash and cigarette butts in the bowl interferes with a cigarette placed in the supports of the ashtray. There are also ashtrays found in offices or public places, such as those ashtrays having a sand bottom or those having a container underneath a trap-door arrangement. Sand ashtrays are especially difficult to clean as well as being difficult to displace, and those ashtrays having a trap-door arrangement usually have no supports for cigarettes and are usefull only as recipients for butts.

In addition ordinary ashtrays present a certain fire hazard: smokers often leave their lit cigarettes on the edge of the ashtray with the incandescent end precariously balanced. As the cigarette consumes itself and becomes shorter it fall over the edge and out of the ashtray. One need only consult the statistics supplied by the insurance companies to realize the frequent number of fires caused by this kind of accident.

Accordingly it is an object of the present invention to provide an ashtray which can contain a number of butts and a quantity of ash without interfering with one or more lit cigarettes placed on the ashtray and which does not require frequent emptying.

It is another object of the present invention to provide an ashtray which automatically extinguishes cigarettes and cigarette butts placed in its supports without having to crush them.

It is a further object of the present invention to provide an ashtray which allows by a simple manoeuver to empty cigarette butts into a container provided for that purpose.

These objects are realized in accordance with the present invention by a main hollow body having an open top forming an opening provided with a unit of semi-tubular supports in parallel spaced-apart relationship. The supports are in two horizontal series, one being in a superior position in top, and the other directly underneath, upside down. The unit is displacable in a pivotal fashion around two transverse and co-axial control pivots such that the series of semi-tubular supports in the superior position is flipped over and the second series which was upside down assumes the superior position. The unit is supported by the pivots which are in two notches on two parallel opposite flanges of the main body. These two flanges project vertically upwardly from two opposite sides of the main body. Immediately underneath each of these two flanges the two sides are provided with a horizontal slit and a chute attached to the sides and opening into slit. Each chute consists of a plate inclined slightly upwardly and provided on each of its two sides with flanges, triangular in shape which are oriented upwardly and outwardly. These two chutes serve as conduits for ashes and used wooden or cardboard matches.

The two other opposed sides of the main body are preferably each provided with two supports as described hereabove attached horizontally in one-above-the-other relationship. These supports are indentical to the ones which constitute the unit described hereabove.

The objects of the present invention and the above summary will be more clearly understood by referral to a preferred embodiment of the invention illustrated by way of the accompanying drawings in which.

Figure 1:
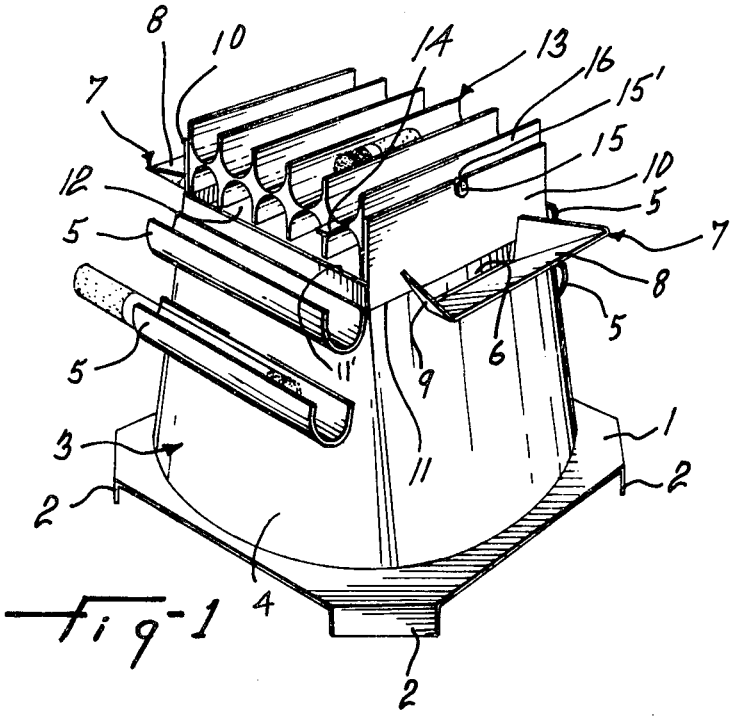
FIG. 1 is a perspective view of the ashtray showing a cigarette and a butt in two of the supports.

A base 1 consisting of a horizontal plate having four flanges 2 bent vertically downwards upholds the main body 3 which is attached to the base 1. The lower surface 4 of the main body is round and is inclined toward the interior like a cone, but the surface 4 gradually is defined into four equal sides going progressively up the main body thus forming a square at the top. The edges of these four sides define the perimeter of an opening 12 of main body 3 which is hollow.

Both of the two lateral sides are provided with two semi-tubular supports 5 attached horizontally in one-above-the-other relationship. These supports are identical in shape and form.

Each of the two longitudinal sides is provided with a slit 6. The lower edge of each of these slits 6 is provided with a chute 7 consisting of a trapezoidal plate 8 upwardly inclined which in turn is provided on each of its two lateral sides with triangular shaped flanges 9. These are inclined to the exterior and toward the top. The two chutes 7 serve to receive ashes and burnt wooden or cardboard matches which slide down chute 7, go through slit 6 and fall into the interior of the main body 3. Slit 6 is not wide enough to admit a cigarette, eliminating the possibility that a lit cigarette falls into the interior of main body 3.

The two longitudinal sides are also provided with a flange 10 having a rectangular form and projecting vertically from edge 11 of the two longitudinal sides.

A unit or cover 13 serves to close the top opening 12 and is composed of two series of semi-tubular supports identical to the supports 5; one series in a superior position, and the other directly underneath and upside down are pivotally displacable. The unit 13 is situated between the two flanges 10 and does not extend beyond the two lateral sides. The two series each consist of five semi-tubular supports which are identical and are in longitudinal parallel spaced-apart relationship.

Figure 2:
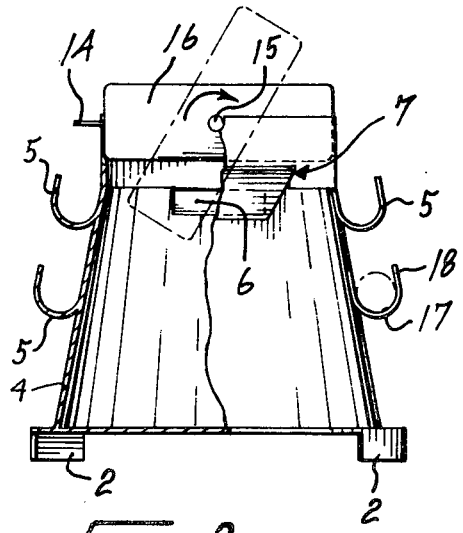
FIG. 2 is a partially sectioned side view.
Figure 3:
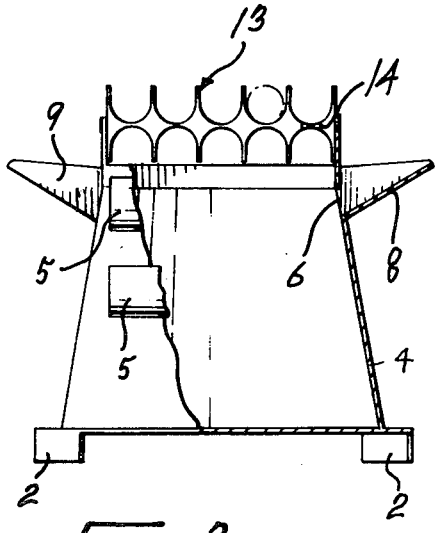
FIG. 3 is a partially sectioned side view at right angles to FIG. 2. Like numerals refer to like elements throughout the drawings.

When one or more extinguished butts occupy the semi-tubular supports in a superior position one can be rid of the butts by following the following simple procedure by pushing on tab 14 projecting from a lateral side of unit 13, unit 13 pivots about two transversal and co-axial pivots 15 which are attached in the middle of the two sides 16 fitted in a notch 15' situated on the top edge of each of the two sides 10. In this way unit 13 flips over, as shown in FIG. 2, and the butts with their ashes, due to the abrupt stop of unit 13 caused by tab 14 which abuts against side edge 11, fall into the main body. When unit 13 has pivoted 180 degrees the series of semi-tubular supports which was upside down assumes the superior position, and vice versa. To flip over unit 13 a second time, the pivoted action is simply reversed and so on. Unit 13 is kept in a horizontal position by tab 14 which abuts against side edge 11' which may be higher than shown and by friction between the surface 16 and flanges 10 on each side.

The special shape of the semi-tubular supports is in conformity with one of objects of the invention stated hereabove. A cigarette placed in one of these supports goes out rapidly and by itself. Contour 17 as shown clearly in FIG. 2 conforms precisely to the diameter of a cigarette. When combined with side 18 which is higher than a cigarette the support effectively cuts off air and thus oxygen for combustion of the cigarette and consequently the cigarette goes out.

The ashtray is very useful in an automobile because the driver, to extinguish his butts has to crush them, necessitating attention which reduces his concentration at the wheel; it is also very practical for a mother who is taking care of young children.

The present invention could be very useful in a public place such as an office, a hotel, a night club or a discotheque. On the one hand it is evident that the invention reduces almost to nil the risk of fire caused by a forgotten or neglected cigarette, which can happen often; for example in a night club when a smoker leaves his table to go and dance. Also the number of supports accomodates several smokers at the same time and reduces the number of ashtrays necessary for a group of people together. On the other hand the semi-tubular supports conserve tobacco by extinguishing the cigarette and prevent accordingly the locale or the room from becoming smoky, which non-smokers would greatly appreciate. Also the tobacco conserved represents a saving for the smoker. Finally, but not less importantly, the necessity of relighting a cigarette every time it is placed in the semi-tubular supports could encourage a heavy smoker to reduce his or her quantity of consumption.

What I claim is:

1. An ashtray comprising a generally box-shaped container serving as a receptacle for extinguished cigarette butts, said container having a top portion forming four side walls defining at their top edges a square or rectangular top opening, said top edges including a first pair of substantially parallel top edges and a second pair of substantially parallel top edges perpendicular to, and at a higher level, than the top edges of the first pair, each top edge of the second pair having a notch located centrally thereof, a square or rectangular cover for closing said top opening, said cover having axially aligned pivot pins secured to, and projecting from, two opposite sides of said cover and removably engaging said notches, a tab secured to, and projecting from, one of the other two opposite sides of said cover and abutting one or the other top edge of said first pair upon pivoting of said cover about said pivot pins through half a turn in one or in the other direction, said cover formed by two oppositely disposed series of semi-tubular cigarette supports disposed in side-by-side parallel relationship and secured together, the support of one series being secured to the support of the other series, each support having a semi-circular bottom and straight sides rising up in parallel spaced-apart relationship and in full diameter from said semi-circular bottom, at least as high as the cigarette placed in said support, the supports of one series opening at one main face of said cover and the supports of the other series opening at the opposite main face of said cover, said cover being held in a used position with one or the other series of said supports facing upwardly and with the cover closing said opening by frictional engagement of the sides of said cover provided with said pivot pins with the side walls of said container having said notches and by said tab abutting against one top edge of said first pair, said cover being removable from said container by the simple disengagement of the two pivot pins from their respective notches, flipping of said cover through half a turn causing emptying of the extinguished cigarette butts placed in the upwardly facing supports into the interior of said container and bringing the other series of supports to an upwardly facing position ready to receive additional cigarette butts.

2. An ashtray as claimed in claim 1, wherein said container has an opening in the side thereof and a chute secured to said side and emptying into said opening, said opening and said chute serving as a means to dispose of burnt matches and ashes, said opening being in the form of a slit narrower than the diameter of a cigarette, whereby a lit cigarette cannot fall through said slit into said container.

* * * * *